United States Patent [19]

Smith

[11] 4,372,566

[45] Feb. 8, 1983

[54] MOLDED BASE PLATE FOR ROLLERSKATES ATTACHABLE TO SHOES

[76] Inventor: Richard D. Smith, 28640 Vista Madera, San Pedro, Calif. 90732

[21] Appl. No.: 303,362

[22] Filed: Sep. 18, 1981

Related U.S. Application Data

[63] Continuation of Ser. No. 140,131, Apr. 14, 1980, abandoned.

[51] Int. Cl.[3] ..... A63C 17/02

[52] U.S. Cl. ..... 280/11.19; 280/11.28

[58] Field of Search ..... 280/11.19, 11.27, 11.28, 280/11.2, 11.3, 11.12, 87.04 A

[56] References Cited

U.S. PATENT DOCUMENTS

| | | | |
|---|---|---|---|
| 2,502,153 | 3/1950 | Jack | 280/11.28 |
| 2,558,696 | 6/1951 | Van Horn | 280/11.28 |
| 2,739,819 | 3/1956 | Stoner | 280/11.28 |
| 3,024,033 | 3/1962 | Skaggs | 280/11.28 |
| 3,526,976 | 9/1970 | Jacobs | 280/11.3 |
| 3,738,673 | 6/1973 | Iseman | 280/11.28 |
| 3,868,121 | 2/1975 | Ware | 280/11.2 |
| 4,058,323 | 11/1977 | Ware | 280/11.28 |
| 4,103,917 | 8/1978 | Widolf | 280/11.28 |
| 4,181,316 | 1/1980 | Brand et al. | 280/11.2 |
| 4,194,752 | 3/1980 | Tilch et al. | 280/11.28 |

FOREIGN PATENT DOCUMENTS

| | | | |
|---|---|---|---|
| 2210997 | 9/1973 | Fed. Rep. of Germany | 280/11.28 |

*Primary Examiner*—David M. Mitchell

*Attorney, Agent, or Firm*—Herzig & Walsh Inc.

[57] ABSTRACT

An integral molded base plate or platform for carrying a set of roller skate wheels and which is attachable to a shoe. The base plate or platform is in a single piece. It has a flat upper surface and it has bores normal to the surface to which the chassis members carrying the wheels are attached by through bolts. The base plate has an integral longitudinal reinforcing rib on its under side which has formed in it receptacles to receive the ends of brace members that extend from the chassis frames that carry the roller skate wheels. There is an integral slanting or beveled front surface having a slant bore for attachment to the base plate of a toe stop member, preferably formed of plastic.

2 Claims, 4 Drawing Figures

MOLDED BASE PLATE FOR ROLLERSKATES ATTACHABLE TO SHOES

This is a continuation of application Ser. No. 140,131, filed on Apr. 14, 1980, and now abandoned.

BACKGROUND OF THE INVENTION

1. Field of the Invention

The field of the invention is that of devices which are attachable to shoes and especially roller skates, the improvement residing in the base or platform member which carries the roller skate wheels and which is attachable to the shoe. More particularly, an improvement resides in constructing the base member from molded plastic as a unitary integral item characterized that it is very light.

2. Description of the Prior Art

With respect to the prior art in the field of roller skates and the like, typically of course, a platform member or base is provided to which the chassis members carrying the wheels are attached. Generally, in the prior art, this base member has been made of metal and quite frequently of die cast construction, which was relatively expensive. Further, the member after being die cast required further fabrication operations including being drilled and tapped to provide the necessary holes for attachment of the chassis members carrying the wheels. Generally the attachment holes were not normal to the surface of the base member, but were at any angle which tended to complicate the machine operations in completing the fabrication and the assembly of the chassis members to the base member. Further, a product as identified in the prior art was relatively expensive initially and it was less than economical considering the fabrication steps to complete it.

The herein invention, a preferred form of which is described in detail seeks to overcome all of the deficiencies and drawbacks of the prior art as identified in the foregoing, while realizing a roller skate which is very light.

SUMMARY OF THE INVENTION

A preferred exemplary form of the invention is described in detail herein. In a preferred form, it is a unitary integral molded base member or platform member for roller skates, the member providing for simlified and economical attachment and securement of the chassis members carrying the wheels to it. It may be made as an integral item in production by an injection molding process.

In the preferred form, the integral member has a flat upper platform surface adapted for securement to the sole of a shoe. On the underside it has a longitudinal extending reinforcing rib provided with openings or receptacles in which can be received the ends of brace members which extend from the chassis members that support the wheels and which are bolted or otherwise secured to the base or platform member. The base or platform member in addition to the longitudinal reinforcing rib has circular extending reinforcing bosses, each having an attachment bore which is normal to the flat surface of the member to which the chassis members carrying the wheels are attachable by way of through bolts, the heads of which are countersunk in appropriate countersinks in the flat surface of the platform member.

At the front end of the base or platform member it has an extending part with a beveled or slant surface having a bore to which is attachable a plastic toe stop member, the attachment being by way of a bolt extending through the toe stop with a nut in an appropriate recess in the top surface of the base or platform member.

In the light of the foregoing, a primary object of the invention is to provide and to realize a base or platform member for roller skates which is adapted for having roller skate wheels secured thereto and to which a shoe may be secured.

A further object is to realize an item as in the foregoing which can be fabricated as a single integral unit by way of a plastic injection molding process.

A further object is to realize a product as in the foregoing having reinforcing ribs and bosses and having securement holes for securing the chassis members carrying the wheels, which are normal to the upper flat surface of the member to facilitate fabrication and assembly.

A further object is to realize a product as in the foregoing constructed to facilitate molding and to simplify machine operations in completing the fabrication and in assembly of the chassis members and wheels to the base member.

A further object is to realize a product as in the foregoing having a reinforcing rib on the underside formed with recesses or openings configurated to receive the ends of brace members extending from the chassis members which carry the wheels.

A further object is to realize a product that is a roller skate that is very light due to the light weight of the base which carries the wheels which are attached to the shoe.

Further objects and additional advantages of the invention will become apparent from the following detailed description and annexed drawings.

DESCRIPTION OF THE PREFERRED EMBODIMENT AND BEST MODE OF PRACTICE

Figure 1:
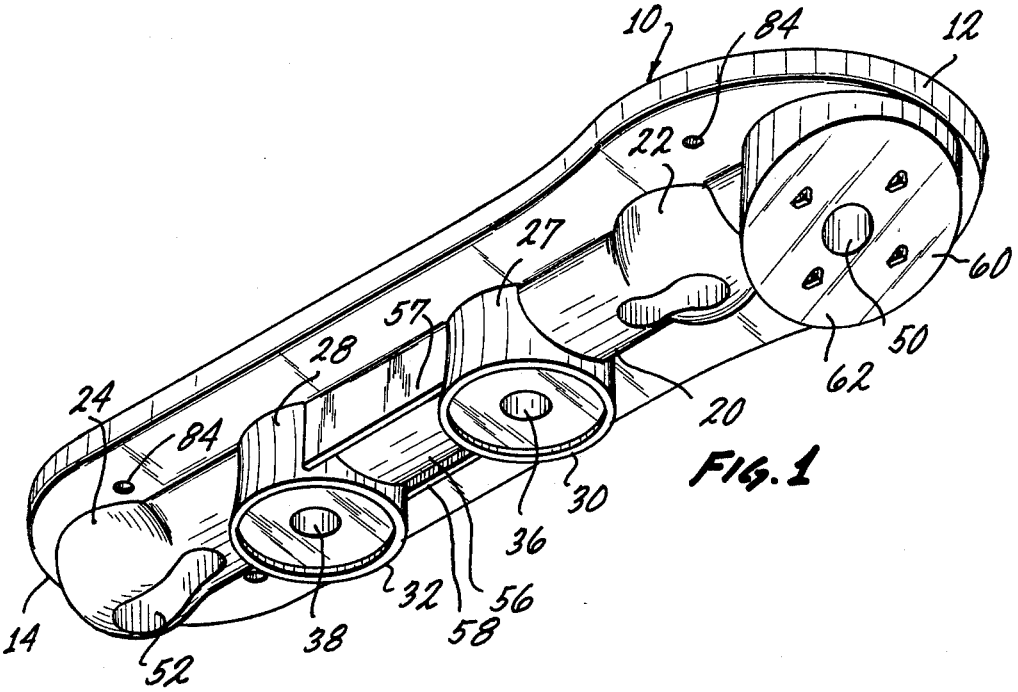
FIG. 1 is an isometric view of the under side of the integral base or platform member of the invention.
Figure 2:
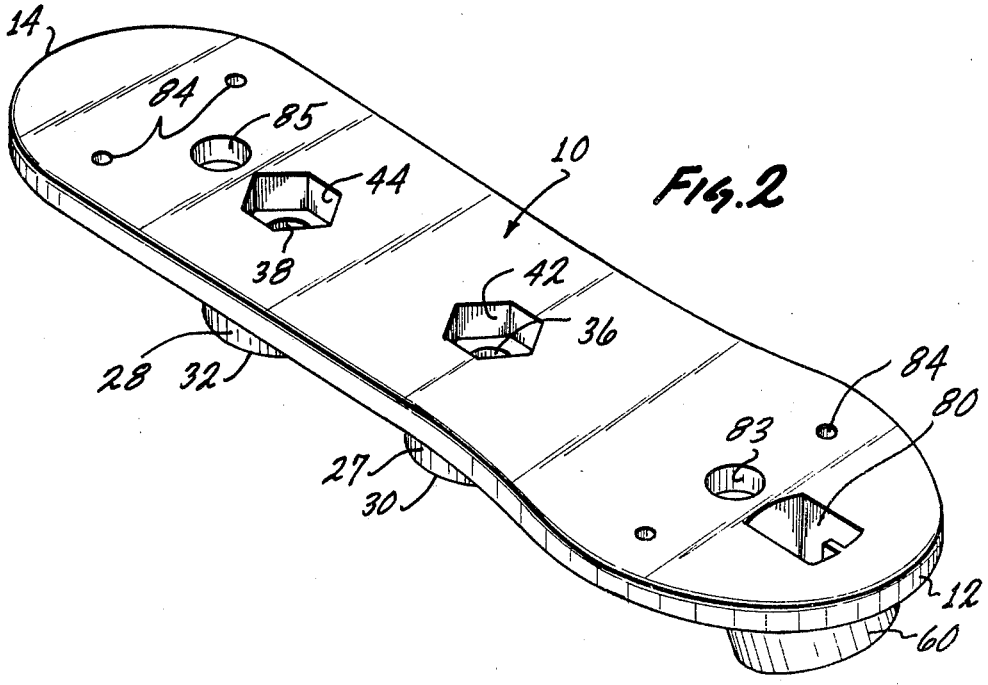
FIG. 2 is an isometric view showing the topside of the integral base or platform member.

Referring to FIGS. 1 and 2 of the drawings, these figures show a preferred form of the baseplate or chassis plate to which the wheels are secured. It is preferably molded by a plastic injection molding process as a single integral unit. It may be molded from various types of plastic or other materials. The top forms a flat plate as designated at 10 in the figures, having a shape as shown and being adapted for attachment of a shoe to the plate. The front ends of the plate are of rounded configuration as shown at 12 and 14.

Integrally formed on the underside of the plate is longitudinal reinforcing rib 20. At the front end of this rib is an enlargement formed in it as designated at 22, which is generally spherical. At the other end of the reinforcing rib 20 is a similar rounded enlargement 24.

At intermediate positions in the rib 20 are generally cylindrical bosses 27 and 28 which on their lower sides have flanges as shown at 30 and 32. These bosses are in a position normal to the surface of the plate 10 and each has a central bore, these bores being designated as 36 and 38, the bores being normal to the surface of the plate 10. At the upper ends of these bores, formed in the surface of the plate 10, are receptacles or countersinks 42 and 44, shaped to receive the hexagonal heads or bolts which secure the chassis frames to the platform member as will be described.

Advantages are gained by having the bores 36 and 38 at right angles to the surface of the plate 10. The advantage stems from the fact that by having the bores in this position the molded product can be more readily released from the mold. In other words, the bores are created in the molding process by way of cores and with these cores at right angles to surface 10 of the product it can simply drop off the cores.

Figure 3:
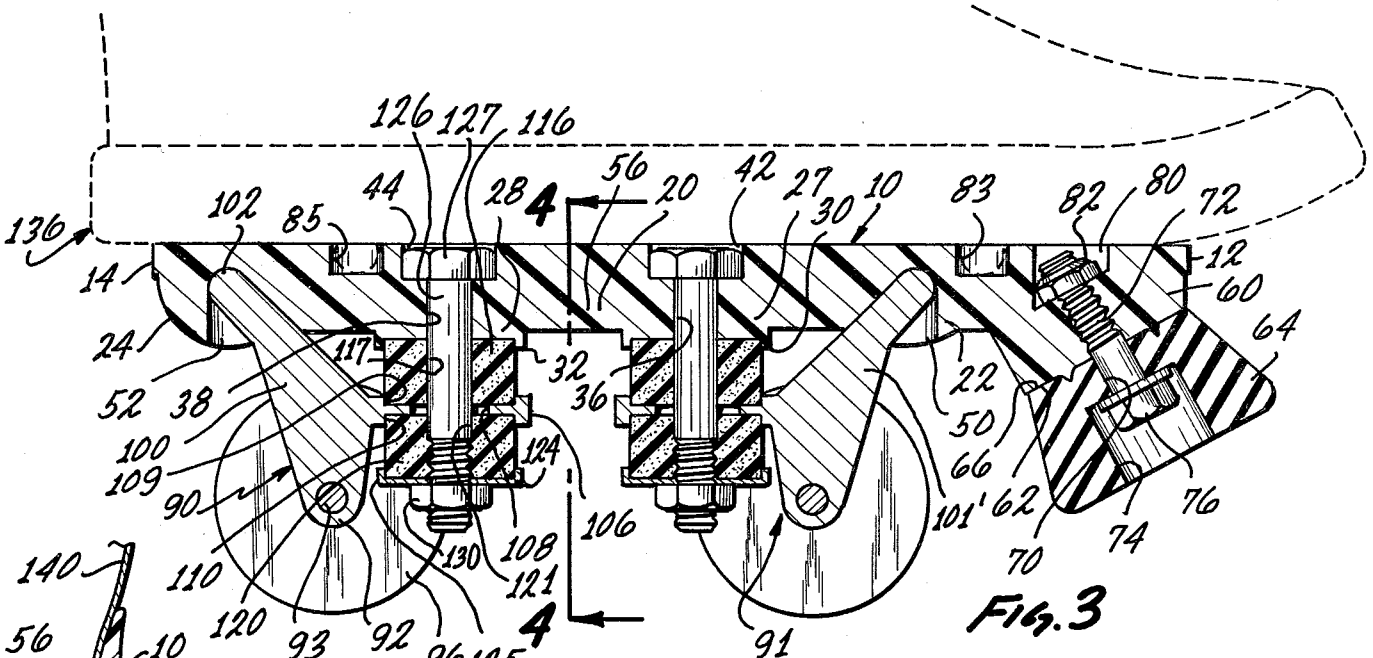
FIG. 3 is a cross sectional view of the member of FIGS. 1 and 2 showing its relationship to a shoe and showing the chassis members that carry the wheels in assembled relationship.

Formed in the enlargement 22 is a slot 50 having a slanting upper surface as may be seen in FIG. 3. Formed in the enlargement 24 is a similar slot 52 having a slanting upper surface as may be seen in FIG. 3. The purpose of these slots will be described presently.

The configuration of the slots 50 and 52 is significant in the construction of the base member by a molding process. It is to be noted that there is no undercut in these slots or openings. This makes it possible to use a mold, which does not have sliding cores mounted at an angle which have to be withdrawn. It is to be seen that cores in the mold that would form the openings 50 and 52 would be at right angles to the platform 10 and the product could simply drop off the cores without there being a need for cores positioned on a slant that would require that they be slid out.

The underside of the rib 20 between the bosses 26 and 28 is rounded as may be seen at 56 and on the opposite sides of this rounded portion are ribs 57 and 58.

At the front end of the plate 10 it has an extending circular boss 60 which has a flat end surface which is formed on a slant or at an angle as shown at 62. Numeral 64 designates a toe stop which is a circular configuration having a slight taper, as shown. It has a flat end surface 66 adapted to engage against the surface 62 of the boss 60 there being formed on one of these surfaces recesses to receive projections in the other surface as shown to position these parts relatively. The toe stop 64 may be formed of prophylene, for example by an injection molding process. It has a bore 70 in it to receive the shank of a bolt 72, this bore having a counter-bore 74 in which is received the head 76 of the bolt and also a washer, as shown. Formed in the top surface of the plate 10 as may be seen in FIGS. 2 and 3 is an opening 80 having a flat bottom surface as may be seen in FIG. 3 to receive a nut 82 on the end of the bolt 72 which secures the toe stop to the platform 10 in a position, as shown.

In the top surface of platform 10 are circular recesses 83 and 85 which are for the purpose of receiving projections 87 and 89 formed on the bottom of the shoe sole to be attached to relatively position the platform and the shoe correctly. Platform 10 also has through holes, one of which is shown at 84, for the purpose of accommodating securing means for securing the platform and the wheels carried by the shoe.

Figure 4:
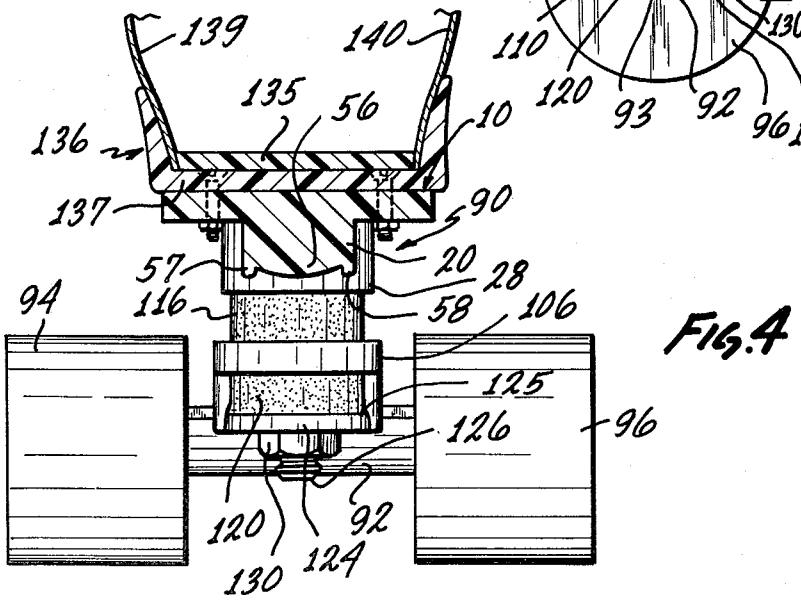
FIG. 4 is a sectional view taken along line 4—4 of FIG. 3.

FIG. 3 shows two chassis frames 90 and 91 which are configurations to be secured to the platform 10 in which carry the roller skate wheels. FIG. 4 is a cross sectional view showing the construction of the frame member 90. It has a transverse part which includes portions, as designated at 92, having a bore which receives a shaft 93 on which are journaled the roller bearing roller skate wheels 94 and 96. Extending upwardly and rearwardly from the main portion of the frame member 90 is a brace member 100, the end of which is rounded at 102 and which fits into the slot.

The frame member 90 has a forwardly extending circular part as designated at 106 which has a bore 108 through which a securing bolt is secured, as will be described. The extending portion 106 has upper and lower circular recesses or counterbores as designated at 109 and 110. Numeral 116 designates a circular cushion member in the form of a grommet having a central bore 117. It seats in the counterbore or countersink 109 in the extending member 106 and its top surface bears against the end of the boss 28 within the flange 32, as shown. Numeral 120 designates a second circular rubber cushion member or grommet having a bore 121 which seats in the counterbore 110 in the lower side of the extending member 106. Numeral 124 designates a washer having a flange 125 which is positioned below the cushion member 120.

Numeral 126 designates a through bolt having a head 127 that seats in the recess 44 in plate 10 as shown. It extends through the bores in the cushion members 116 and 120 and through the bore 108 in the extending member 106 and through the washer 124. Numeral 130 designates a securing nut on the end of the bolt 126.

The forward chassis or chassis frame member 91 is like the one just described except that it is reversed in position with its brace member 101′ extending forwardly. Accordingly, the parts of this member need not be described in detail again.

FIG. 4 shows the platform 10 attached by bolts 135 so the shoe assembly designated schematically and generally by the numeral 136. The shoe has exemplarly shown as a sole 137, inner pad 138 and side walls 139 and 140.

From the foregoing it will be understood that the roller skate itself operates generally as known in the art. The cushioned mountings of the chassis frames which carry the wheels permit absorption of shcoks and allos movements of the frame members 90 and 91 carrying the wheels to permit some sterring of the skates. By tilting a skate forward the flat end surface of the toe stop 64 can be brought into contact with the surface being skated on to stop and hold the skate in a manner know in the art.

From the foregoing those skilled in the art will readily understand the nature and construction of the invention and the manner in which it achieves and realizes all of the objects set forth in the foregoing.

The foregoing disclosure is representative of a preferred form of the invention and is intended to be illustrative rather than limiting, the invention to be accorded the full scope of the claims appended hereto.

What is claimed is:

1. As an article of manufacture in combination, a base plate or chassis plate for carrying roller skate wheels and constructed for securement of a shoe to the base plate, wheel carrying chassis frames secured to the chassis plate, the chassis plate having a generally flat upper surface, the chassis plate having vertical bores normal to said surface spaced from each other, securing members for securing said wheel carrying chassis frames to the plate, said bores having counterbores at their upper ends for receiving said securing members, the said member having parts flush with the upper surface of the plate, there being a single bore for securement of each chassis frame, the chassis frames having angularly extending brace members which extend outwardly at an inclined angle from the wheel axes; downwardly facing recesses formed in the chassis plate configurated to receive the ends of the brace members, said recesses having a longitudinally elongated opening on the lower surface of the chassis plate and having internal surfaces therein for ends of the brace members to abut against, said surfaces having a shape whereby a core member in a mold can be removed relatively in a direction normal to the base plate.

2. An article as in claim 1 wherein said recesses are free from any undercut part whereby in the molding operation the base plate can be separated from cores positioned to pull out of the recesses without the need of using cores of the type that have to be slid out in order to remove the molded part.

* * * * *